United States Patent [19]

Pera et al.

[11] Patent Number: 4,986,696

[45] Date of Patent: Jan. 22, 1991

[54] METHOD OF DEWATERING A SUBSTERRANEAN SPACE, ESPECIALLY A MINE

[75] Inventors: Ferenc Pera; György Szentai, both of Veszprém; Zsolt Kesserû, Budapest; Péter Tóth, Veszprém; László Kapolyi, Budapest, all of Hungary

[73] Assignees: Veszprémi Szénbányák, Veszprém; Kózponti Bányázati Fejilesztesi Intezet, Budapest; Országos Foldtani Kutano és Furo Vallalat, Várpalota, all of Hungary

[21] Appl. No.: 274,971

[22] Filed: Nov. 22, 1988

[51] Int. Cl.[5] ..... E21F 17/00

[52] U.S. Cl. ..... 405/36; 299/11; 405/52

[58] Field of Search ..... 405/52, 53, 54–59, 405/36; 299/2, 11, 12, 18

[56] References Cited

U.S. PATENT DOCUMENTS

| | | | |
|---|---|---|---|
| 2,126,575 | 8/1938 | Ranney | 405/36 X |
| 2,787,125 | 4/1957 | Benz | 299/2 X |
| 3,026,096 | 3/1962 | Love | 405/52 X |
| 3,469,405 | 9/1969 | Reinhold | 299/11 X |
| 3,705,851 | 12/1972 | Brauer | 405/36 X |
| 4,153,297 | 5/1979 | Ridley | 405/39 X |

*Primary Examiner*—Dennis L. Taylor

*Attorney, Agent, or Firm*—Birch, Stewart, Kolasch & Birch

[57] ABSTRACT

A method of dewatering a subterranean space, especially a mine, comprising artificially tapping a water storage zone or collecting water of imbibition and flooding a refill zone, which is separated from said subterranean space by an impermeable seam, with said water through the use of a subterranean pumping station and at least one refill boring, wherein each refill zone is directly flooded with said water from said subterranean space without said water being raised to the surface and then reintroduced to said refill zone.

6 Claims, 4 Drawing Sheets

METHOD OF DEWATERING A SUBSTERRANEAN SPACE, ESPECIALLY A MINE

BACKGROUND AND SUMMARY OF THE INVENTION

The present invention is directed to a method of dewatering a subterranean space, especially an underground mine, which comprises collecting water artificially tapped from a water storage zone or collecting water of imbibition and transferring the water, through the use of a subterranean pumping station and at least one refill bore hole to a refill zone, said subterranean space being separated from said refill zone by an impermeable layer.

The most common way to dewater a mine is to collect the water tapped from the mine or the water of imbibition and to raise it by a pump to the surface. When the loss of the water balance in the layers tapped by mining has to be moderated, the water or part of the water raised from the mine is pumped back to the subterranean water storage zones, usually through injection wells.

The twofold technical task, namely to remove the water from the mine-field continuously and to return the stock of water abstracted from the subterranean water storage zone, is a well known prior art method which is complicated and expensive. Also, when reinjecting the water from the surface, the risk of contamination is enhanced.

It is an object of the present invention to eliminate the above insufficiencies by providing a method of removing the water from mine-fields and other subterranean spaces and returning it to the subterranean water-system at reduced cost and less risk of contamination than exists in the known methods.

The concept of the present invention is based on the perception that the water tapped from the subterranean water storage zone for protecting the subterranean space or the water of imbibition can be directed from the same subterranean space to a refill zone for maintaining the subterranean water balance if two conditions are met. The first condition is that there should be a zone of sufficiently high hydraulic resistance between the tapped subterranean space and the refilled zone of the subterranean water-system.

The second condition is that between the mine-fields and the refill zone of the subterranean water-system there should be an impermeable seam in which the water pressure causing the spontaneous hydraulic cracking exceeds the injection pressure in use.

If the first condition is not met by the refill zone, the water output of tapped water or the amount of water of imbibition is strongly increased.

If the second condition is not met, the water pressed back to the subterranean water-system will cause hydraulic cracking through the impermeable seam and thus the water of the subterranean water storage system will rush into the mine while it is being refilled.

According to the present inventive method of dewatering a subterranean space, especially a mine, the method comprises artificially tapping a water storage zone or collecting water of imbibition and transferring the water through a subterranean pumping station to a refill zone which is separated from said subterranean space by an impermeable seam. The water is transferred to the refill zone using at least one refill boring, and is achieved by flooding said refill zone directly from said subterranean space with said water without first raising the water to the surface.

Another characteristic feature of the present invention involves flooding said refill zone by a pressure less than both the hydraulic resistance between said water storage zone and said refill zone and the lowest rock strength of said impermeable layer between said subterranean space and said refill zone.

The present method further comprises test blasting said impermeable layer and measuring the blasting strength of the impermeable layer and transferring the water to said refill zone at a pressure of at least 5%, preferably 10 to 15% less than said blasting pressure (strength).

In a given case the method may include reducing the refill pressure by methods, such as e.g., acid treatment and/or blasting in said refill borings.

In a further aspect of the present method a packing material or cement material may be placed in at least one bore hole between said water storage zone and said refill zone so as to increase the impermeability of the impermeable layer.

In another feature, the present method may include clarifying said water of imbibition before flooding said refill zone.

In performing the present method at least part of the water of imbibition or the water tapped from the water storage zone by filter wells, in a manner that is already known in itself for protecting the mining operation, is collected preferably in a closed or at least contamination protected gravity collector duct and conducted to a reinjecting pumping station set up in the mine.

Through the reinjecting pumping station, after a treatment, if necessary, the water is refilled through reinjecting borings to the sector of the water storage zone that is separated from the tapped zone of the subterranean water storage system by a zone of high hydraulic resistance and separated from the mine-fields by an impermeable seam with a strength against hydraulic cracking greater than the injection pressure.

In the case of tectonically or by impermeable interlayers cut in subterranean water storage zones, the sufficient hydraulic resistance between the tapped and injected zones can be achieved also by the proper selection of the water storage zone. In other cases the hydraulic resistance between the tapping and refilling zones should be increased by filling the routes of water at least partly as additional measurements.

The safety against hydraulic cracking of the impermeable seam between the mine or other subterranean space and the refill zone of the water storage should be checked by two gauges, namely the pressure gauge of the experimental blasting injection in the impermeable seam and the pressure gauge of the experimental reinjection in the water storage zone.

Depending on measured values, the most unfavorable smallest strength against cracking should be increased suitably by determining the distance between the refill zone and the mine, at most up to the limit according to the original stress condition and/or by reducing the necessary refill pressure either by increasing the number of refill borings or by known methods, e.g. acid treatment or blastings, applied in the reinjection wells.

There may be an extremely favorable water storage to be refilled, the water pressure of which permits refilling by absorption, without pumping.

BRIEF DESCRIPTION OF THE DRAWINGS

The invention will now be described in connection with the following examples.

DESCRIPTION OF THE PREFERRED EMBODIMENTS

Figure 1:
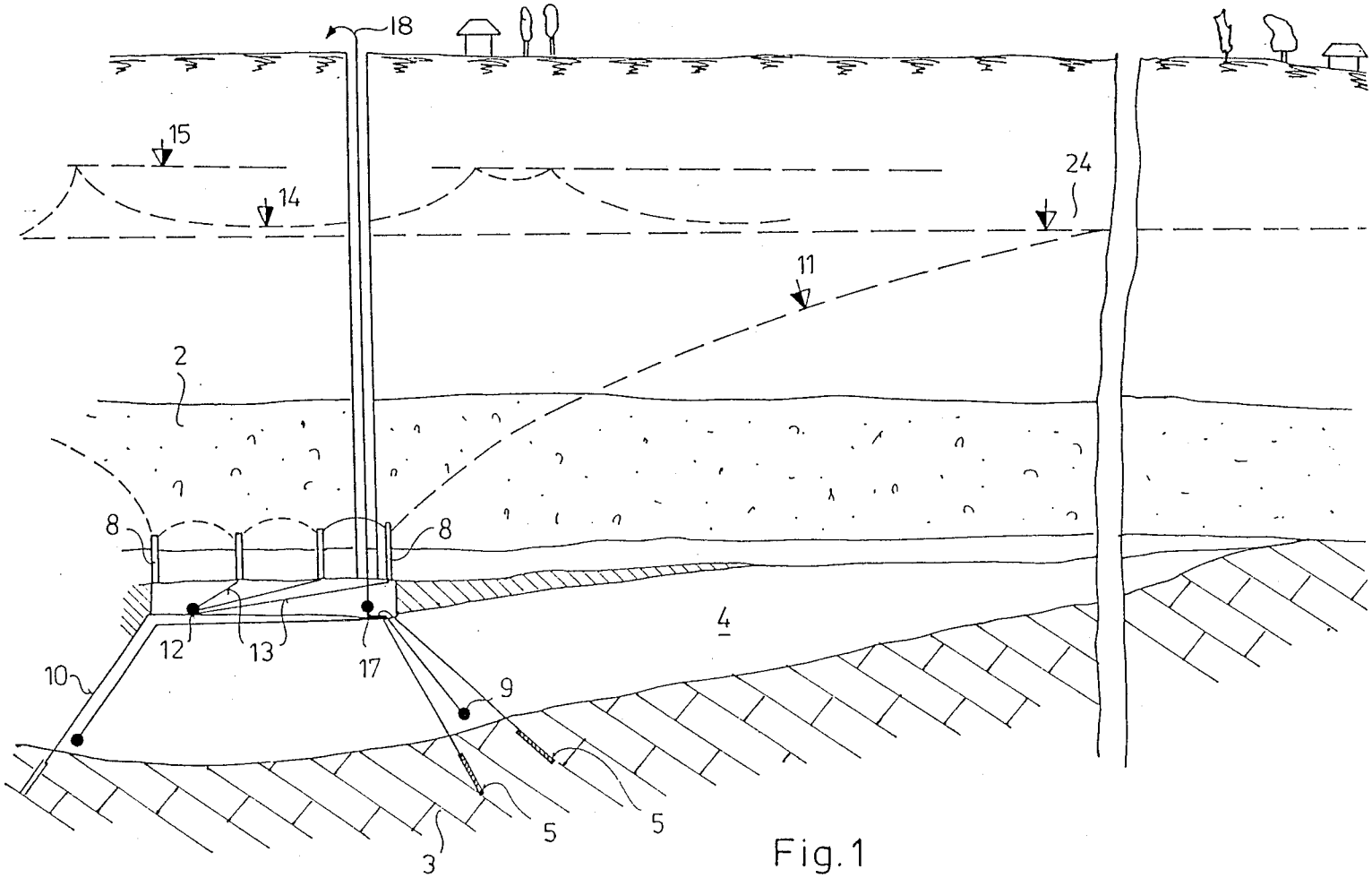
In FIG. 1 an example of the method according to the invention is shown for the hydro-geological circumstances wherein the layers to be tapped and to be refilled are in distant hydraulic contact. The application example shown in FIG. 2 relates to the case wherein both the tapping and refilling are carried out in the same water storage, however the tapping and refilling areas are hydraulically not directly connected, due to a tectonic displacement. The example shown in FIG. 3 is directed to the case, wherein the connection between the tapping and refill zones is diminished by partially packing the water routes.

In FIG. 1 above the subterranean space 1 established in the deposit 22 is the water storage zone 2, endangering the subterranean space 1. A great distance from the deposit 22 it is in hydraulic contact through a discordance of layers with the refill zone 3 under the subterranean space 1, and separated from the subterranean space 1 by the impermeable seam 4. The water storage zone 2 is tapped by the tapping borings 8 initiated from the subterranean space 1 itself for protecting the subterranean space. Tapping the initial water level 24 of the water storage zone 2 produces the depressed water level 11. During the period before refilling, the tapped water is raised to the surface by the safety pumping station 17 through the delivery pipe 18. Before starting the refilling, the cracking pressure $P_r$ necessary for cracking up the impermeable seam 4 should be gauged in the blasting-injecting boring 9 set next to the planned reinjection in the impermeable seam 4, on one side of the refill zone 3, and then the blasting-injecting boring 9 is fully packed with an afterhardening material. Then in the experimental refill boring 10 set in the refill zone 3 started in the direction of the previous blasting experiment, an experiment for the reinjection of water is carried out by a reinjection pressure which is 85 to 90% of the cracking pressure $P_r$ at most, to determine the water amount which can be refilled by the refill pump 12 through one boring.

As additional measurements known produce increasing methods, e.g. produce increasing blasting may be applied. Having gauged the delivery of tapping and the delivery which can be refilled through one well, the system of the tapping borings 8 and the refill borings 5 should be extended simultaneously, to achieve the desired purpose. The water of the 8 tapping borings, after settling, are conducted through the pipeline 13 and the refill pump 12 to the refill borings 5. Each of the refill borings 5 are equipped with a known pressure reducer, e.g. a blow-off valve, suitably adjusted at 90% of the $P_r$ cracking pressure.

By the above measurements the water level 14 before refill of the 3 refill zones is altered, so that the pressure of the raised water level 15 will always be less than the cracking pressure $P_r$ causing the cracking up in the impermeable seam 4.

The unsettled part of the water from the tapping borings 8 is raised to the surface by the safety pumping station 17 through the delivery pipe 18. The capacity of the safety pumping station 17 is dimensioned in case of a breakdown in part of the tapping-refilling system.

Figure 2:
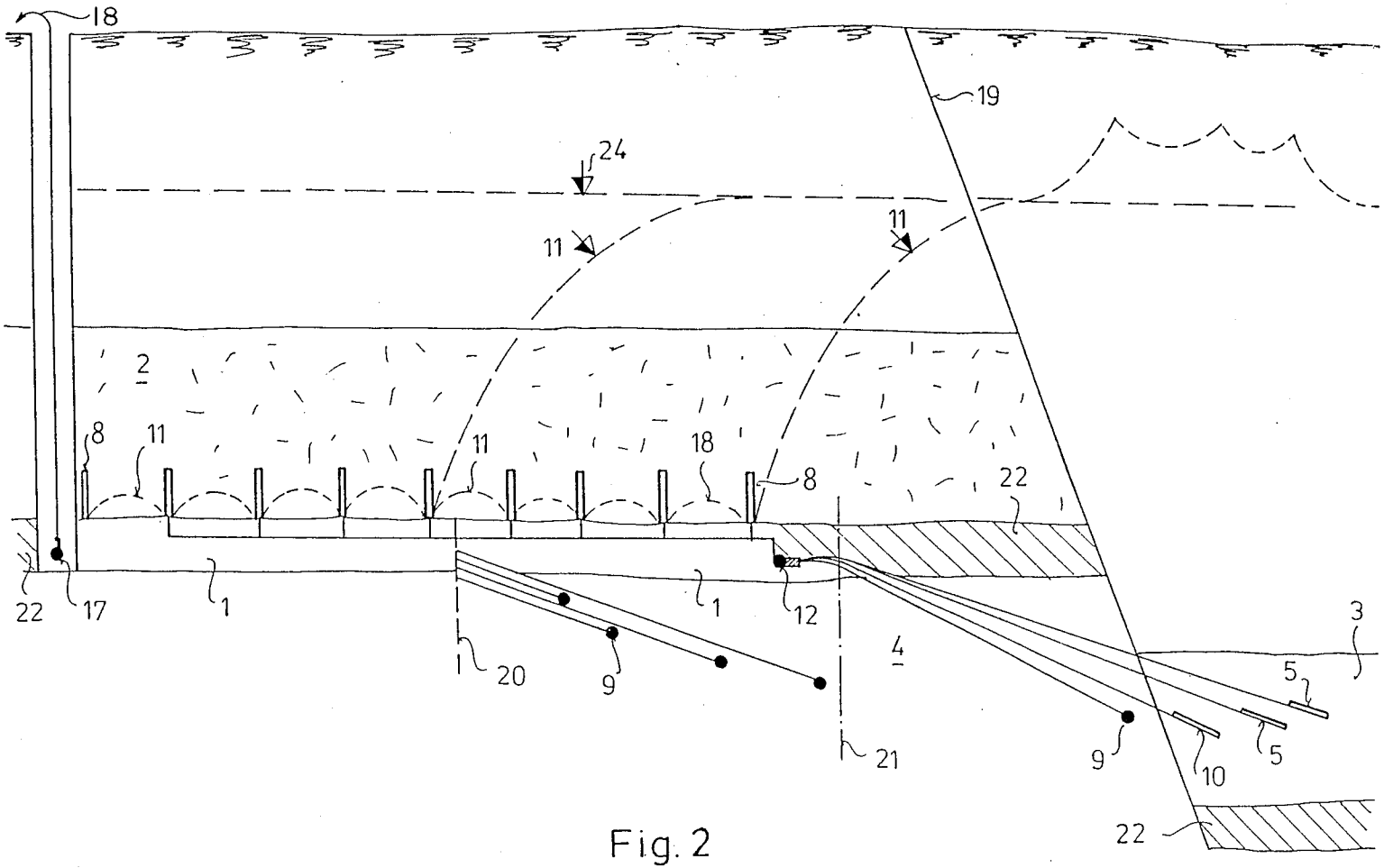

The example shown in FIG. 2 can be applied in the case the water storage zone 2 is tectonically cut, that is, there is a sufficiently high hydraulic resistance between the tectonically divided parts. In FIG. 2 the water storage zone 2 is in the closest cover of the subterranean space 1. The refill zone 3 is separated by the impermeable seam 4 from the water storage zone 2 because of a tectonic displacement 19. In this case the subterranean space 1 can approach the refill zone 3 to the extent that the impermeable seam 4 provides protection against hydraulic cracking. Therefore the mining operation can be first extended up to the preliminary field barrier 20, a safe distance of about 100 to 150 m to the refill zone 3, then the cracking pressure $P_r$ is gauged in a set of blasting-injecting borings 9 directed to the refill zone 3. Knowing the gauged values, the distance from the subterranean space 1 to the refill zone 3 is determined so that the reinjecting pressure is 85 to 90% of the $P_r$ cracking pressure, lest it exceed the original water pressure of the refill zone 3. Thereafter the subterranean space 1 approaches the refill zone 3 up to the allowable field barrier 21 under the protection of the tapping borings 8 and the safety pumping station 17. Then a new blasting-injecting boring 9 is placed and the value of the cracking pressure is gauged in it. Depending on the gauged values the procedure should be repeated or followed according to the example shown in FIG. 1.

Figure 3:
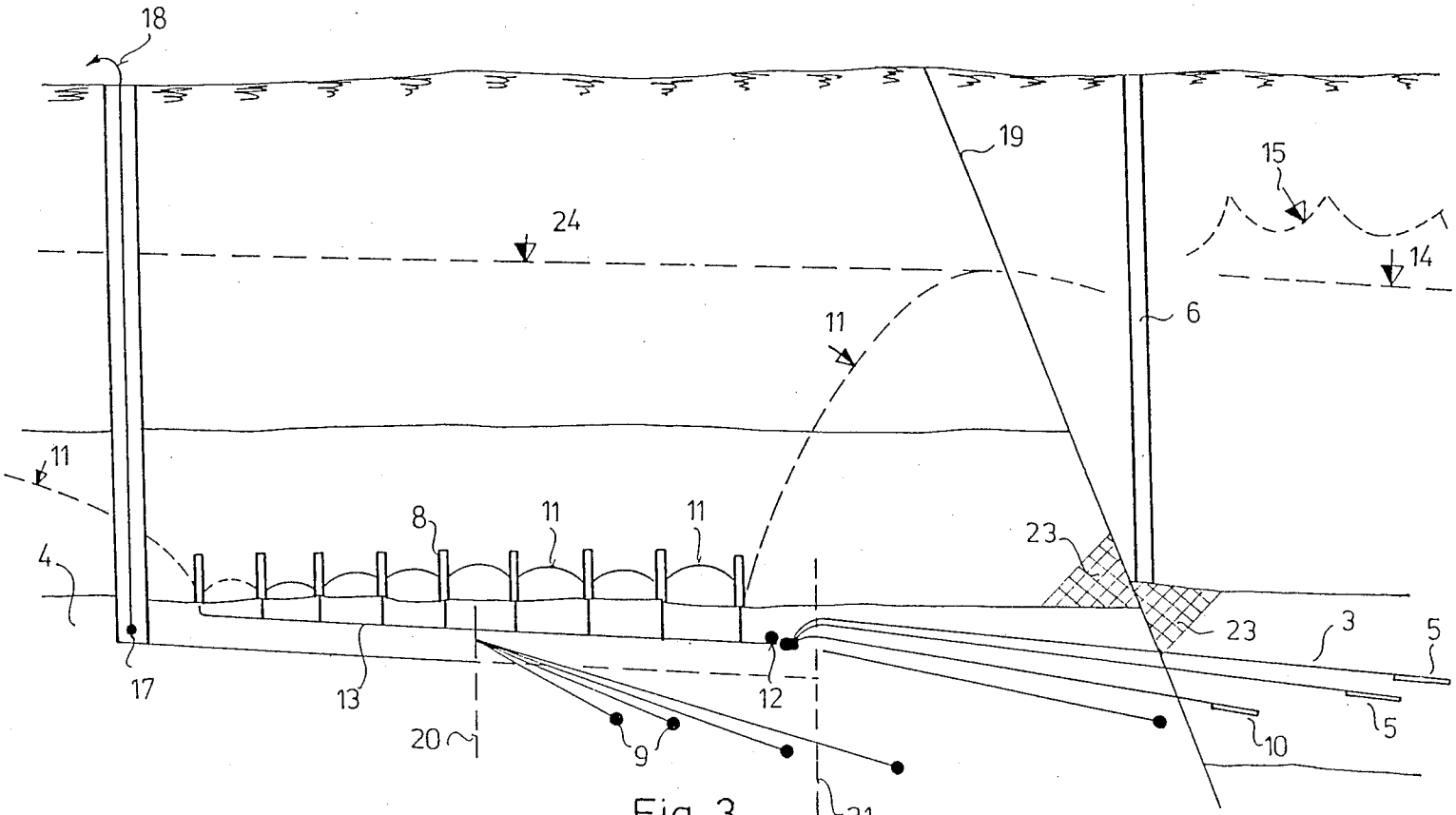

In FIG. 3 the difference in the hydro-geological situation shown in FIG. 2 is that the tectonic displacement 19 did not disturb the hydraulic contact between the water storage zone 2 and the refill zone 3. In this case the water routes along the tectonic displacement 19 should be at least partly packed through the packing borings 6 laid suitably from the surface, thus establishing the zone 23 of increased hydraulic resistance. The further procedure is as in the example of FIG. 2.

Figure 4:
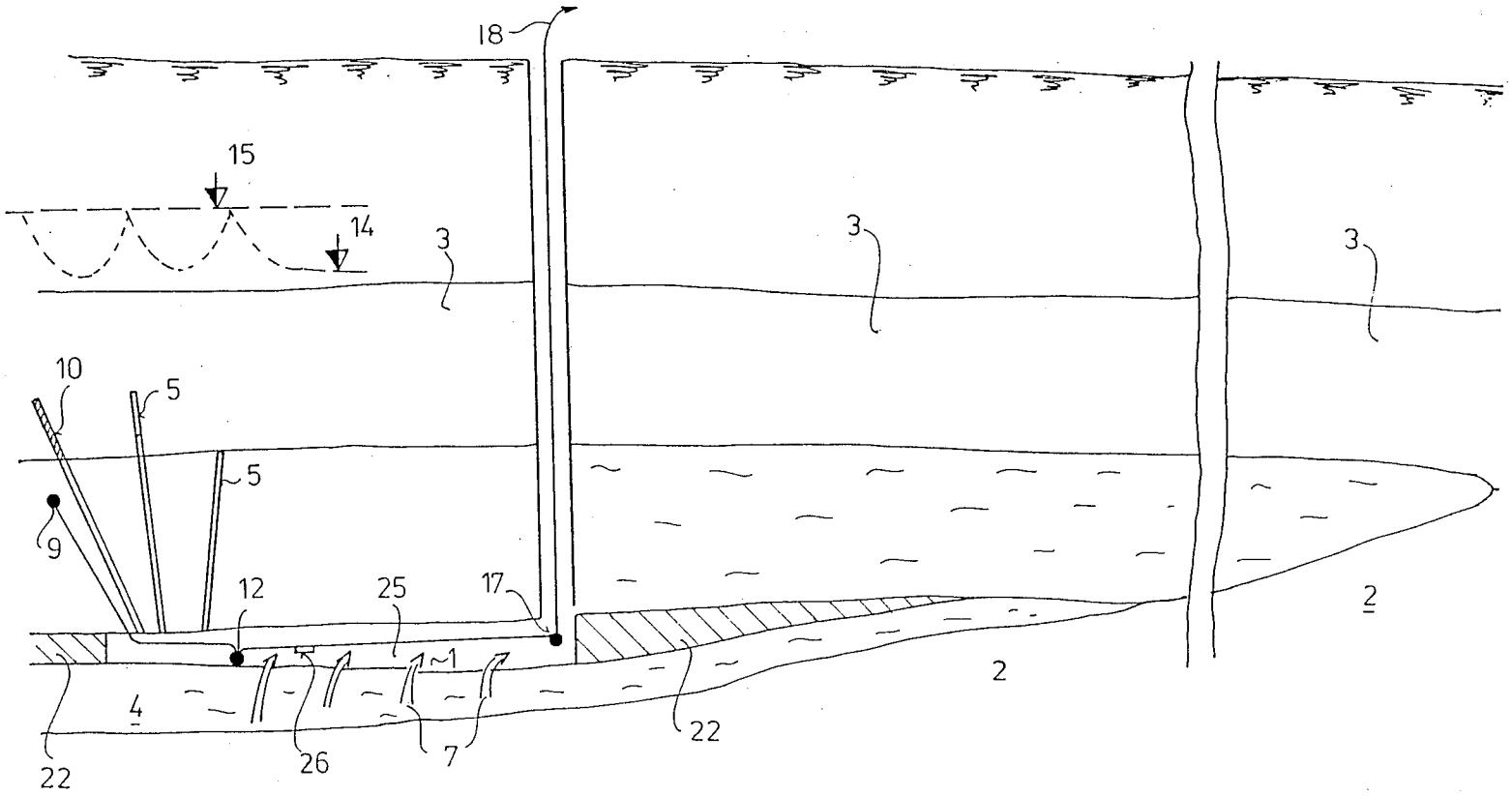
FIG. 4 relates to the case when the purpose is to moderate the output of the water-raising in an already operating mine, e.g. for lack of capacity or to reduce delivery costs and the harmful water economic effects of tapping the subterranean water storage system in the same time. A further difference to the previous examples is that the water appears in the mine as a water of imbibition instead of or beside the tapping borings.

In FIG. 4 the water 7 of imbibition appears in the subterranean space 1 from the underside water storage zone 2 through the insufficient thickness of impermeable seam 4 and is conducted by the gravity duct 25 to the safety pumping station 17. For refill, the cover-side refill zone 3 can be counted on, the water level before refill of which is much lower than the surface level.

The water storage zone 2 and the refill zone 3 are hydraulically contacted by a discordance of layers just as in the geological situation in FIG. 1. The subterranean space 1 is separated from the refill zone 3 by the impermeable seam 4.

First experiments to determine the allowable refill pressure have to be carried out in the blasting-injecting boring 9. Next comes the refill experiment in the experimental refill boring 10. After this the refill borings 5 can be laid as shown in FIG. 1. When the system of refill borings 5 is ready for operation, a part of the water of imbibition fixed beforehand is conducted to the clarifier 26 from where it is pumped by the refill pump 12 to the refill borings 5.

Applying this method, the safety pumping station 17 can be partly released, and thus the energy expenses of the water being raised can be reduced by the difference between the raised water level 15 and the surface level, and the water balance can be improved by the amount of water refilled.

The advantages of the application of the method according to the present invention are as follows: The water tapped from the subterranean water system is returned directly to the refill zone and thus the investment and operation expense of dewatering and refilling are reduced when compared to that of known methods. The costly water treatment before refilling is generally unnecessary because the water is usually treated entirely closed.

Often, especially when the original water pressure is relatively low and the refill zones are of good permeability, the costs of raising the water level according to the method of the present invention are even lower than that of the method wherein the water is just raised to the surface without being returned. That means that the water-saving method according to the present invention is cheaper than the traditional water-wasting method.

Due to this advantage, the method according to the present invention can even be applied where other methods are not economical.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of dewatering a subterranean space, especially a mine, which comprises collecting water of imbibition or water artificially tapped from a water storage zone and transferring this water through a subterranean pumping station and at least one refill borehole to a refill zone without raising the water to the surface of the ground, an impermeable layer separating said subterranean space from said refill zone.

2. The method according to claim 1, wherein the water is transferred to the refill zone at a refill pressure lower than the hydraulic resistance between the water storage zone and the refill zone and lower than the lowest rock strength of the impermeable layer between the subterranean space and the refill zone.

3. The method according to claim 1, wherein the impermeable layer is test blasted and the blasting strength of the impermeable layer is measured whereby the water is transferred to the refill zone at a pressure at least 5%, and preferably 10 to 15% less than said blasting strength.

4. The method according to claim 1, wherein the refill pressure is reduced by the use of boreholes.

5. The method according to claim 1, wherein voids in the impermeable layer are filled with an afterhardening material so as to increase the impermeability of said impermeable layer.

6. The method according to claim 1, wherein the water of imbibition is clarified before being transferred to the refill zone.

* * * * *